United States Patent [19]

Ferrell

[11] 4,149,498

[45] Apr. 17, 1979

[54] INTERNAL COMBUSTION ENGINE

[76] Inventor: Arthur T. Ferrell, #2008 5600 Orangethorpe, La Palma, Calif. 90620

[21] Appl. No.: 743,173

[22] Filed: Nov. 19, 1976

[51] Int. Cl.[2] ..... F02B 75/26

[52] U.S. Cl. ..... 123/58 AA; 123/78 F; 123/80 D; 123/190 D; 123/190 DA; 60/712

[58] Field of Search ..... 123/58 R, 58 A, 58 AA, 123/58 AM, 80 D, 80 DA, 190 D, 190 DA, , 197 AB, 41.4, 48 B, 78 F, 78 R, 48 R; 60/597, 712; 91/480, 499

[56] References Cited

U.S. PATENT DOCUMENTS

| | | | |
|---|---|---|---|
| 1,352,985 | 9/1920 | Murphy | 123/58 AA |
| 1,628,100 | 5/1927 | Bacon | 123/78 F |
| 1,808,083 | 6/1931 | Tibbetts | 123/58 AM |
| 2,183,122 | 12/1939 | Manrodt et al. | 123/190 DA |
| 2,587,842 | 3/1952 | Hall | 123/80 DA |
| 3,943,895 | 3/1976 | Howell | 123/58 AA |
| 3,990,242 | 11/1976 | Muller | 60/597 |

FOREIGN PATENT DOCUMENTS

| | | | |
|---|---|---|---|
| 501118 | 11/1954 | Italy | 123/58 AA |

*Primary Examiner*—Charles J. Myhre
*Assistant Examiner*—Craig R. Feinberg
*Attorney, Agent, or Firm*—Herzig & Walsh, Incorporated

[57] ABSTRACT

An internal combustion engine is provided that has a stationary cylinder block in which cylinders contain reciprocating pistons that are sequentially actuated to impart torque to a revolving rotor. A unique rotor is provided that includes a cam surface that controls the reciprocation of the pistons through followers. Ports in the rotor conduct working fluids to and from the cylinders. An exhaust blow-down nozzle is provided in the rotor that transforms kinetic energy in the exhaust into additional torque. There is no residual gas fraction present during combustion and the engine operates with true constant volume combustion.

15 Claims, 10 Drawing Figures

INTERNAL COMBUSTION ENGINE

BACKGROUND OF THE INVENTION

The constant volume fuel/air cycle is used as a standard of comparision because it represents an upper limit of 100% efficiency. Compared to this ideal cycle, a typical four-stroke internal combustion engine is 20% less efficient, turning 80% of the available thermal energy in its fuel into work, during the expansion stroke. The twenty percent (20%) of lost energy is divided between heat loss (12%); time loss (6%) and exhaust blow-down loss (2%). Heat loss is heat transferred to the coolant during the expansion stroke. Time loss is piston motion during combustion. Exhaust blow-down loss is due to the opening of the exhaust valve (or port) before bottom dead center of the expansion stroke in order to minimize exhaust stroke loss.

The invention operates approximately 8% closer to the ideal thermal cycle. The invention utilizes true constant volume combustion (There is no piston motion during combustion) to eliminate time loss. Expansion continues all the way to bottom dead center without early blow-down to eliminate exhaust blow-down loss.

The invention is inherently 8% more efficient in the utilization of its fuel, resulting in substantial fuel savings.

In addition, an integral exhaust blow-down nozzle, in the rotor of the invention, captures kinetic energy that is released as the cylinder pressure reduces to the pressure of the exhaust system, before the exhaust stroke begins. No valve overlap period at the end of a more complete exhaust stroke results in no dilution of the fresh mixture on the next stroke by any residual gas fraction.

Other features include the elimination of any separate cam shaft, the elimination of all timing gears and simplicity of construction resulting in low manufacturing costs and ease of maintenance.

SUMMARY OF THE INVENTION

In essence, the invention is an internal combustion engine that contains a hollow cylindrical block; one or more pistons within such cylinder block; and a rotor containing intake and exhaust ports; one or more exhaust blow-down nozzles, and a cam device to control reciprocation of pistons.

In the preferred embodiment of the invention, a rotor is cradled in a cylinder block at bearing points near its ends so that it may have rotational motion. Longitudinal motion along its axial centerline is restricted by thrust bearings at a thrust flange located between two enlarged portions of the rotor.

Also mounted in the cylinder block are one or more pistons. The pistons reciprocate in cylinders parallel to the axial centerline of the rotor and at equal radial distances from it. The cylinders are also located between the enlarged portions of the rotor.

The lower enlarged portion is a flywheel with a flange of undulating configuration wrapped around it (dashed lines in FIG. 2). This flange is a cam that controls the reciprocational motion of the pistons through followers that straddle it.

In operation, the rotor rotates relative to the cylinder block and in so doing, ports in the upper enlarged portion of the rotor register with cylinders in the cylinder block and pistons, following undulating configuration of cam, reciprocate in cylinders. In one revolution of the rotor, each piston will move through one complete cycle.

FIG. 9. is a diagram illustrating the operation of the engine. In FIG. 9, it can be seen that (A to B) the piston compresses a fuel-air charge into the clearance volume and a spark plug is engergized to ignite the charge (Point B). Followers are on the flat portion of the cam so that the piston does not move until combustion is complete (B to C). In FIG. 10, a pressure volume diagram with the same points shown, it can be seen that the pressure in the cylinder has reached a maximum at Point C. The pressure now forces the piston down against a sloping portion of the cam flange causing rotation of the rotor (C to D). As expansion continues, pressure drops in the cylinder (C to D), but there is still substantial pressure within the cylinder (Point D, FIG. 10) when the following again finds a dwell on cam flange and the piston stops at bottom dead center while the exhaust blow-down port is uncovered (D to A'). Pressure. is reduced down to atmospheric by expanding through the exhaust blow down nozzle, leaving the rotor at a tangent angle. Kinetic energy from exhaust gases is thereby transferred to the rotor to increase torque on output shaft. After blow down, the exhaust port is brought into alignment with cylinder and piston ascends to a point as close to cylinder cover plate as practical to purge the cylinder (A' to E). At Point E, the exhaust port has closed and intake port has not yet opened, preventing an overlap period when fresh mixture can short circuit the engine and insuring that there will be no dilution of the charge with residual (exhaust) gases.

The piston descends drawing in a fuel-air charge (E to A'') and the port is covered. The cycle is ready to start again.

DETAILED DESCRIPTION OF THE PREFERRED EMBODIMENT

Figure 1:
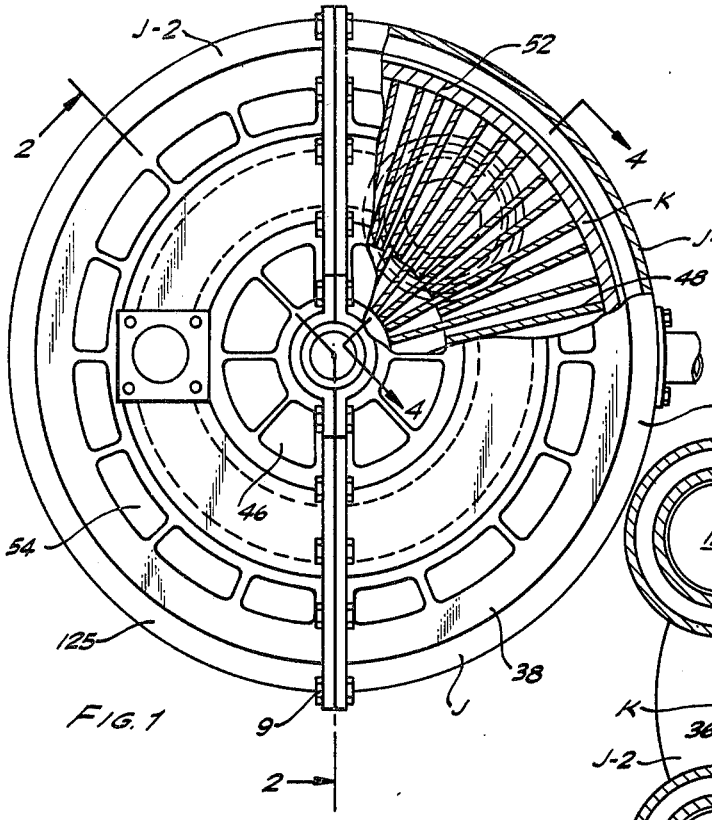
FIG. 1 is a top view, partially broken away, of an internal combustion engine in accordance with the invention.
Figure 3:
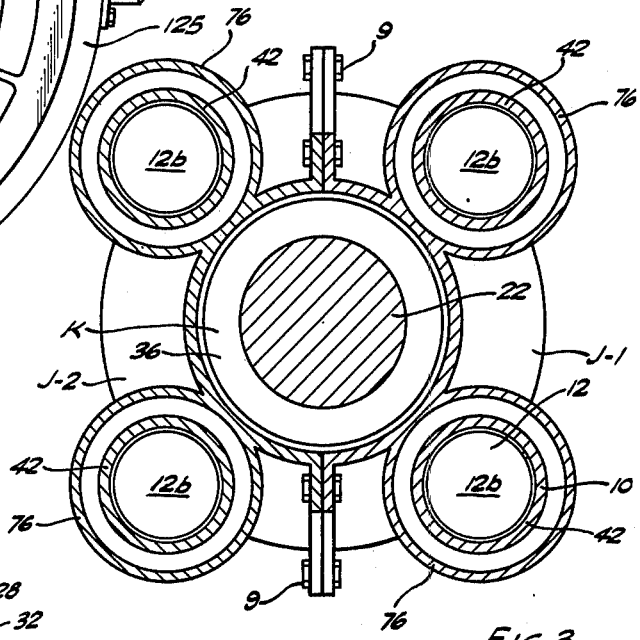
FIG. 3 comprises a sectional view taken along the line 3—3 of FIG. 2.
Figure 2:
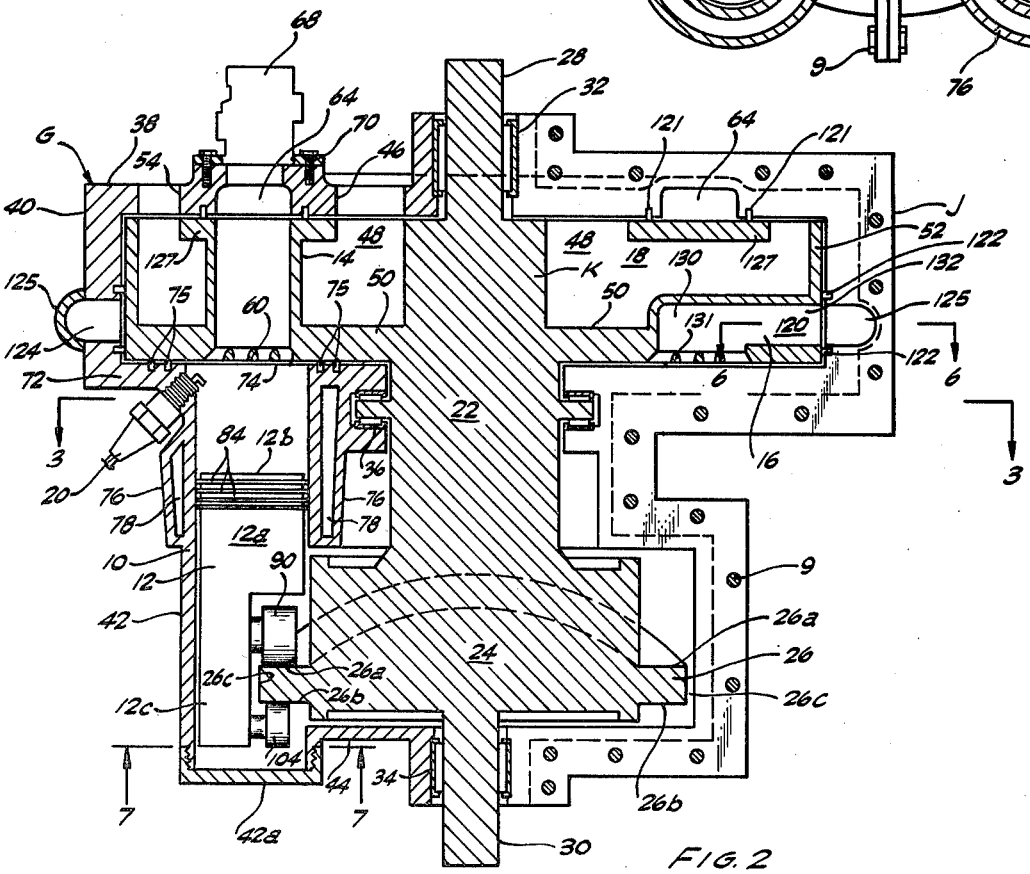
FIG. 2 comprises a sectional view taken along the lines 2—2 of FIG. 1.

The internal combustion engine of the invention can best be seen by review of FIGS. 1-3. The engine includes a stationary cylinder block J that is preferably defined by first and second flanged sections J 1 and J 2 that are removably held in abutting contact by bolts 9 or other suitable fastening means. Cylinder block J has one or more cylinders 10 formed therein. The cylinders, when more than one, may be arranged in circumferentially spaced relationship such as shown. The engine includes piston 12 slidably and sealingly mounted in each of the four cylinders 10. Any number of pistons and cylinders may be used.

The engine includes a rotor K with first and second axially aligned shafts 28 and 30 that are rotatably supported in cylinder block J by first and second bearings 32 and 34. Rotor K includes a cylinder head 50 and a cam flange 26.

The rotor may be an assemblage of parts secured together to rotate as one piece or may be made in one piece.

Cylinder head 50 includes an intake port with grille 60 which is used to induct fuel/air charge from intake manifold 64 to cylinder 10. A duct-like member extends from the cylinder head plate 50 to a circular plate 127 that acts as a floor to intake manifold 64. Grille is used to prevent loss of compression rings 75.

Figure 6:
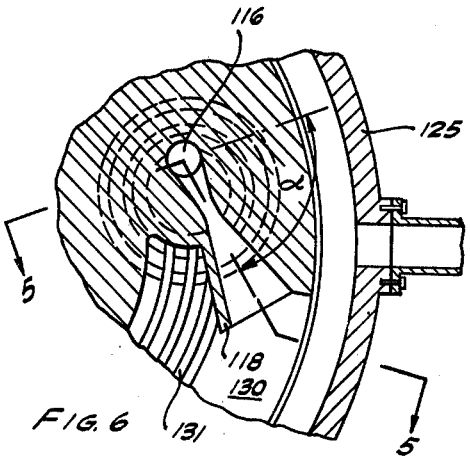
FIG. 6 is a fragmentary, sectional view taken along the lines 6—6 of FIG. 2.
Figure 4:
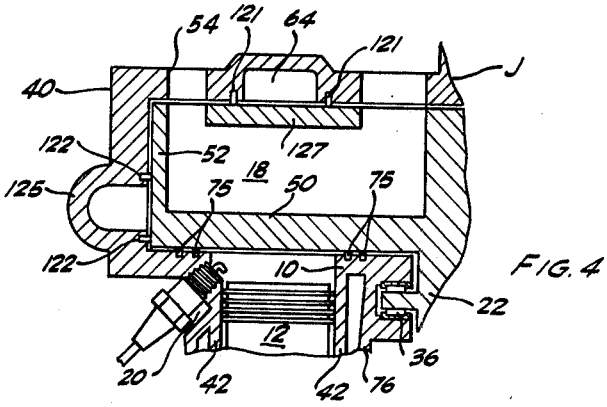
FIG. 4 is a fragmentary, sectional view taken along the lines 4—4 of FIG. 1.
Figure 5:
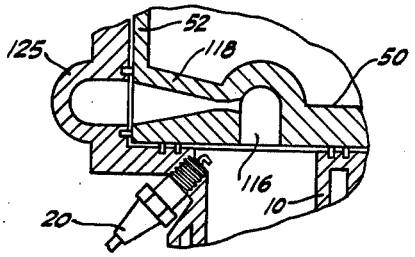
FIG. 5 is a fragmentary, sectional view taken along the lines 5—5 of FIG. 6.
Figure 7:
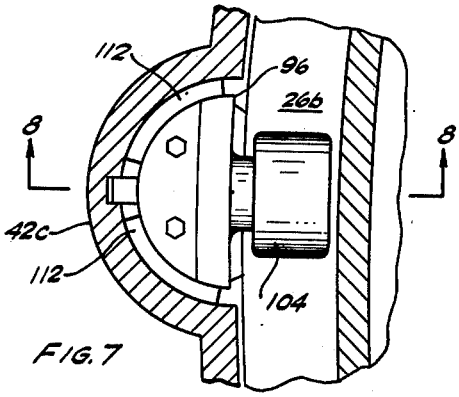
FIG. 7 is a fragmentary, enlarged, sectional view taken along the lines 7—7 of FIG. 2.

The exhaust blow-down nozzle means seen in FIG. 5 and FIG. 6 includes a port 116 formed in cylinder head plate in the form of a rotary valve plate 50 that is in communication with a member 118 of nozzle shaped transverse cross section that extends tangentially towards wall 52.

The exhaust gases discharge at an angle alpha tangent to the rotor K impacting kinetic energy to the rotor K from the exhaust before it is discharged to the exhaust manifold 125.

Exhaust port means includes a port with grille 131 formed in cylinder head 50. A tubular member 130 extends toward port 132 formed in circular wall 52. Port 132 also defines the blow-down exit port.

The tubular member 130 acts to channel residual gases, from cylinder 10 to exhaust manifold 125 mounted on the shell.

Cooling fins 48 act as a fan to pull air through the openings 46 in the shell over fins 48 and out through other openings 54 in the shell.

Rotor K also includes an intermediate cylindrical portion 24 that acts as a flywheel and has a cam flange 26, the use of which will be explained later, of undulating configuration projecting outwardly therefrom.

Third bearing means 36 is operatively associated with intermediate flange portion 22 and cylinder block J. Thermal expansion is negligible at the gap between rotary valve plate 50 and port register plate 72 because thermal expansion in a direction along the shaft originates from thrust flange 22 and thrust bearing 36.

Two output shafts on opposite ends of rotor 28 and 30 transmit torque and may be used to drive accessories such as an oil pump, water pump and distributor.

Piston 12 is preferably defined by first and second sections 12*a*and 96 that are removably held in abutting contact with adjusting shims 99 between them by bolts 9 or other suitable means.

Figure 8:
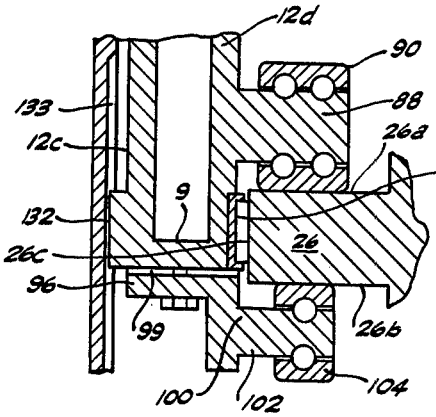
FIG. 8 is a sectional view taken along the lines 8—8 of FIG. 7.

Each piston 12 includes a cylindrical portion 12*a*that has a dome 12*b*. Portions 12*a* have longitudinally spaced resilient oil rings and compression rings 84 mounted thereon as shown in FIG. 2. Each piston 12 also includes an extension that is defined by an elongate shell 12*c* of semi-circular transverse cross section and a longitudinally extending wall 12*d*as shown in FIG. 8. Each wall 12*d*has a stub shaft 88 projecting therefrom on which a thrust absorbing roller follower 90 is rotatably supported. Follower 90 contacts a first surface 26*a* cam flange 26. Second section 96 of L-shaped or other shaped transverse cross-section has a stub shaft 102 projecting therefrom on which another roller follower 104 is rotatably supported. Follower 104 is in rolling contact with a second surface 26*b* of cam flange 26.

First bearing segments 112 are secured to the exterior surfaces of piston portions 12*c* and slidably engage the interior surfaces of the cylinders 42. A third bearing segment 114 is secured to the exterior surface of each wall 12*d*and is in slidable contact with the side surface of cam flange 26*c*. These bearings 112 and 114 locate the piston 12 in its cylinder. Engagement of key 132 on piston 12 is in keyway 133 cut in cylinder block J. Such engagement is a method of preventing piston twist which would throw follower out of contact with the cam flange.

Cylinder block J includes an intake manifold means 64; an exhaust manifold means 125; cylinders 10 with coolant passage means 76; mounting points for spark plug 20 or a fuel injector (not shown); and carburator 68. Cylinder block J also includes a first circular end piece 38; a first cylindrical side wall 40; and second side wall 42. First end piece 38 has a number of inner circumferentially spaced cooling slots 46 formed therein that are at all times in communication with the interior of an air cooling passage 18 defined by circular plate 50 and circular wall 52 that projects outwardly therefrom and by the shaft of rotor 22. Interior 18 is at all times in communication with a number of circumferentially spaced outer cooling slots 54 formed in first end piece 38 of cylinder block J. The fins 48 are attached to cylinder block head 50 and rotate to cause air from the ambient atmosphere to be drawn into confined space 18 through slots 46.

First end piece 38 contains intake manifold means in the form of a ring-shaped passage 64 formed therein including port 66 where carburetor 68 is mounted by bolts 70 or other fastening means. First cylindrical side wall 40 contains exhaust manifold means in the form of a circular passage 125 of channel-shaped transverse cross section formed thereon including one or more ports 124. Second side wall 42 has circumferentially spaced cylinders 10 formed as a part thereon. Such cylinders extend outward toward second end piece 44. Cylinder block J at the junction of first and second side walls 40 and 42 defines a transverse ring shaped wall 72.

A number of circumferentially spaced openings 74 are formed in wall 72, each of which openings is in communication with the interior of one or more of cylinders 10. The port register plate is a flat plate 72 with openings through which cylinders 10 communicate with port section 50 on rotor K and also serves as a mounting point for a compression seal (rings) 75 around each cylinder. One spark plug 20 is mounted on cylinder block J at every cylinder 10.

Each cylinder is surrounded by a water jacket 78 or may be air cooled.

The cylinder block has openings for transfer of fresh mixture from carburetor 68 on ring-shaped intake manifold 64 to intake port 60 and of residual gases from exhaust port 132 and blow-down nozzle 118 to exhaust manifold 125 mounted on the shell. The cylinder block also mounts intake leakage seals 121, exhaust leakage seals 122, radial bearings 32 and 34 and thrust bearings 36. Engine accessories may be secured to cylinder block and driven from either output shaft.

One terminal of plug 20 is grounded to cylinder block J. The other terminal of spark plug 20 is connected by an electrical conductor (not shown) to a distributor (not shown).

The combustion chamber is sealed by circumferentially spaced compression rings 75 on wall 72 and compression rings 84 on piston 12.

In operation, the rotor K rotates relative to the cylinder block J and in so doing the pistons 12 reciprocate in the cylinders 10. The ports 60, 116 and 131 register with the openings 74 to conduct working fluids to and from cylinders 10. The positions of the pistons 12 in the cylinder block J is at all times controlled by the followers 90 and 104 associated with each piston being in rolling contact with the circular cam flange 26 that has an undulating configuration. In spark-ignition operation, a distributor causes plug 20 to sequentially spark and ignite an air fuel mixture in each cylinder 10. In diesel operation a fuel injector injects fuel into hot compressed air to cause ignition in each cylinder 10.

Figure 9:
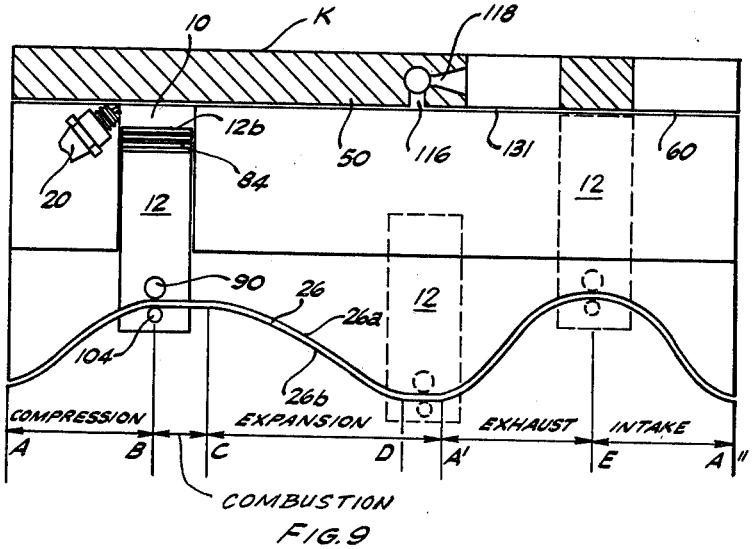
FIG. 9 is a schematic, partially graphic representation of a cycle of an internal combustion engine in accordance with the invention.
Figure 10:
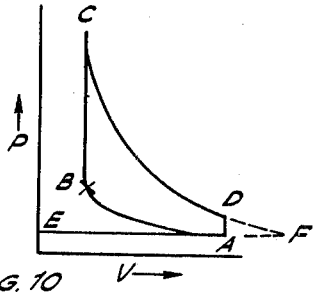
FIG. 10 is a graphical representation of pressure-volume relationships in internal combustion engines in accordance with the invention.

Each piston 12 will move through the cycle illustrated in FIG. 9. The letters used in FIG. 9 are also used to illustrate the change in volume and pressure inside the cylinder as illustrated in FIG. 10. In FIG. 9, it can be seen that at B the piston 12 has compressed a charge of the air fuel mixture into a combustion chamber formed in the cylinder 10 and between rotary valve plate 50 and piston dome **12*b*, at which time the spark plug 20 is electrically energized to fire the charge. The followers 90 and 104 of the piston 12 are on the flat portion (dwell period) of the cam flange 26 and from B to C. Piston 12 does not move during the combustion of the air-fuel charge. In FIG. 10, it can be seen that the pressure of the burning charge reaches a maximum at C. The build up of pressure during combustion now forces piston (and follower) downward on sloping portion of cam flange 26 causing rotor K to turn. The slope can be less severe on this stroke than the others, i.e., intake, exhaust and compression, to extend the stroke over a larger portion of one complete cycle. The expansion between C and D takes place within the cylinder 10 as can be seen in FIG. 9. This expansion accompanied by a drop in pressure as shown in FIG. 10. When expansion in the cylinder is complete at point D, there is still substantial pressure in the cylinder. As the exhaust blowdown port 116 is uncovered by the cylinder, the gas expands to exhaust system pressure. The first elements of gas to escape will acquire a high velocity (kinetic energy) that will be converted into work by exhaust blow down nozzle 118 from D to F in FIG. 10**. Gases will continue to escape this way until the pressure inside the cylinder and in the exhaust system (normally atmospheric pressure) are equal.

At A′, the exhaust port 131 is uncovered at one side of the cylinder. The piston moves toward the rotary valve plate 50 A′ to E removing the remainder of the residual gases. At E the piston is as near to rotary valve plate 50 as possible so that the volume left for a residual gas fraction to accumulate will be at a minimum. The exhaust port 131 rotates to a covered position relative to cylinder and inlet port 60 is then uncovered. Piston 12 moves away from cylinder head plate 50 drawing in a fresh charge at E to A″ preparatory to again beginning the cycle at A. Diesel operation would be the same except that injection would initiate combustion and intake stroke would involve air instead of an air-fuel mixture.

The present invention may, of course, be carried out in other specific ways than set forth herein without departing from the spirit and essential characterization of the invention. The present embodiments are, therefore, to be considered in all respects as illustrations and not restrictions. The invention is to be defined from the following claims:

I claim:

1. In an internal combustion engine having a cylinder block with at least one cylinder with its axis arranged substantially parallel to a rotatable main shaft, and said at least one cylinder having a single reciprocating piston therein, the improvement comprising:

a rotor rotatable with said main shaft, said rotor including a cam flange having an undulating configuration, said piston including a cam follower in rolling contact with said cam flange, ignition and intake and exhaust means operable by said rotor to produce a cycle of operation of said engine, said cam flange being configured such that said piston has a dwell period at the end of its compression stroke during ignition and throughout duration of combustion such that said piston remains substantially stationary and combustion occurs in a space of constant volume.

2. The invention as set forth in claim 1 wherein said cam flange is configured such that said piston moves substantially to the top of the cylinder at the end of the exhaust stroke.

3. The invention as set forth in claim 1 wherein said cylinder includes a cylinder head rotatable with said rotor and defining an intake port and further including axially extending fin means on said cylinder head and being rotatable therewith to produce intake of air into the interior of said cylinder head to cool the latter.

4. The invention as set forth in claim 1 wherein said ignition means comprises fuel injecting means whereby said engine operates as a compression ignition engine.

5. The invention as set forth in claim 1 wherein said ignition means comprises a spark ignition device for initiating combustion in an air-fuel mixture.

6. The invention as set forth in claim 1 wherein said cam flange is configured such that said piston remains stationary during a dwell period at substantially the bottom dead center of the expansion stroke.

7. The invention as set forth in claim 6 further including exhaust gas nozzle means for receiving exhaust gas from said cylinder and positioned to direct exhaust gas to impart kinetic energy to said rotor.

8. An internal combustion engine that includes:

a hollow block that includes a first end piece that has a first opening therein, a second end piece that has a second opening therein aligned with said first opening, a continuous side wall that extends between said first and second side pieces, said side wall partially defining a cylinder parallel to a rotational center line between said openings, a transverse wall that extends inwardly from said side wall intermediate said first and second end pieces with an opening for said cylinder and that has an opening in which a recessed race is defined, a fuel-air mixture inlet opening, an exhaust gas discharge opening;

first and second bearing means supported in said first and second openings, third bearing means supported by the recessed race;

a rotor that includes an elongate body having first and second axially aligned shafts projecting from opposite ends thereof that are journalled in said first and second bearing means, a first transverse plate extending from said body into said third bearing means to maintain said rotor at a fixed longitudinal position relative to said block, a second transverse plate that extends outwardly from said body, and is adjacently disposed to said transverse wall with openings that can be aligned with said cylinder opening on said transverse wall, a circular flange of undulating configuration;

a piston slidably supported in said cylinder, said piston including extensions that extend therefrom towards said second end piece;

a thrust receiving roller follower and idling roller follower rotatably supported from said extensions, said followers engaging opposite side of said flange cam;

a tubular member extending from the second plate towards a ring-shaped plate that is adjacently disposed to interior of block at first end piece, said tubular member in communication with one of the openings in the second plate and with an opening in ring-shaped plate, said ring-shaped plate is adjacent to the interior of a channel on first end piece that has an inlet opening upon which carburetion means may be mounted;

a second tubular member extending from the second plate radially towards a circular wall that is adjacently disposed to the interior of block at side wall, second tubular member in communication with a second opening in second plate and with an opening in circular wall, circular wall is in communication with the interior of a channel on side wall that has an exhaust gas discharge opening;

means for sequentially firing charges of air-fuel mixture that enter said cylinder through said tubular member on the intake stroke of said piston as said piston is at substantially top dead center prior to expansion stroke, each fired charge increasing in pressure and forcing said piston towards said second end piece for said follower to exert a force on said cam flange that results in the rotation of said rotor;

a third opening in said second plate;

Second exhaust gas passage defining means; and

Exhaust gas nozzle means, said second exhaust gas passage defining means connecting said third opening in said second plate and said exhaust gas nozzle means, the latter being adapted to direct exhaust gas through said opening in said side wall so that the reactive forces of said exhaust gas imparts kinetic energy to increase the torque delivered to said rotor, said circular flange of undulating configuration having a dwell period in the configuration of said flange at the end of the expansion stroke such that piston movement is stopped while said exhaust gas nozzle means is in communication with the interior of said cylinder so that all potential energy in the exhaust is focused at said nozzle means and not wasted by moving said piston with a portion of said energy.

9. An internal combustion engine as defined in claim 8 in which said cam flange is of such configuration that each of said pistons has a dwell period at the end of the compression stroke, in order that true constant volume combustions may result.

10. An internal combustion engine as defined in claim 1 in which said cam flange is of such configuration that each piston moves all the way to top of cylinder at the end of the exhaust stroke leaving essentially no clearance volume between piston and cylinder head and exhaust and inlet ports in cylinder head are in such locations that neither are opened to a cylinder at this time to minimize any exhaust gas dilution of incoming charge.

11. An internal combustion engine as defined in claim 8 in which a carburetor is mounted on said first end piece for supplying a fuel-air mixture to said fuel-air mixture inlet opening and in which said means for sequentially firing said charges is a spark plug mounted on said side wall.

12. An internal combustion engine as defined in claim 8 in which said inlet opening in first end piece admits only air and in which means for supplying fuel is injector mounted on said said wall and in which means for sequentially firing said fuel is injection into hot compressed air in the cylinder.

13. An internal combustion engine as defined in claim 8 which in addition includes:

a plurality of circumferentially spaced, radially extending fins that extend from said head assembly above said plate towards said first end piece, said fins as said head assembly rotates causing air from the ambient atmosphere to be drawn into the interior of said cylinder block through a sequence of first ports and discharged from said interior through a sequence of second ports radially spaced in circular configurations on the first end piece, said air being so circulated for cooling purposes.

14. An internal combustion engine as defined in claim 8 in which each of said piston extensions includes:

first bearing segments mounted on said piston extension that slidably engage the interior surface of the cylinder in which the piston is mounted;

second bearing segments on said piston extension that slidably engage an outer surface of said cam flange;

flange extending radially outwards from piston extension that slidably engages slot in interior of cylinder to prevent said piston from rotating and said followers becoming disengaged from said cam flange;

shim plates between piston portions to adjust distance between rollers.

15. The invention as set forth in claim 8 further including means for cooling said cylinder head and cylinders.

* * * * *